US008534753B1

(12) United States Patent
Perez

(10) Patent No.: US 8,534,753 B1
(45) Date of Patent: Sep. 17, 2013

(54) ENTERTAINMENT CHAIR SYSTEM

(76) Inventor: Luis Paul Perez, Miami, FL (US)

( * ) Notice: Subject to any disclaimer, the term of this patent is extended or adjusted under 35 U.S.C. 154(b) by 336 days.

(21) Appl. No.: 13/010,550

(22) Filed: Jan. 20, 2011

(51) Int. Cl.
*A47C 7/62* (2006.01)

(52) U.S. Cl.
USPC ..... 297/188.09; 297/188.13; 297/217.1; 297/217.3

(58) Field of Classification Search
USPC ..... 297/188.08, 188.09, 188.11, 217.1, 297/217.3
See application file for complete search history.

(56) References Cited

U.S. PATENT DOCUMENTS 3,136,578 A * 6/1964 Tihovici ..... 297/188.16
3,213,467 A * 10/1965 Hubbard ..... 297/188.13
3,553,911 A 1/1971 Morrow et al.
3,556,088 A 1/1971 Leonardini
3,923,134 A 12/1975 Rezazadeh
3,948,379 A * 4/1976 Warner ..... 297/217.3
4,594,817 A 6/1986 McLaren et al.
5,086,755 A 2/1992 Schmid-Eilber
5,086,769 A * 2/1992 Vianello et al. ..... 607/94
D336,999 S 7/1993 Yamasaki et al.
6,056,363 A * 5/2000 Maddox ..... 297/325
6,092,868 A * 7/2000 Wynn ..... 297/217.3
6,634,904 B2 * 10/2003 Rowland et al. ..... 439/534
2009/0187125 A1 * 7/2009 Tran et al. ..... 601/49
2012/0118907 A1 * 5/2012 Ochi ..... 221/8

* cited by examiner

*Primary Examiner* — Peter Brown

(57) ABSTRACT

An entertainment chair system for providing a comfortable means of resting and being entertained. The system features a first half platform and a second half platform mounted atop a base, the first half platform can be reclined or elevated. An inner storage compartment is disposed in the base, wherein a door disposed in the base allows and prevents access to the inner compartment of the base. A television with a mounting system is pivotally attached to the first half platform. The mounting system functions to position the television parallel to the first half platform. A dispensing system is disposed below the base.

9 Claims, 5 Drawing Sheets

ENTERTAINMENT CHAIR SYSTEM

FIELD OF THE INVENTION

The present invention is directed to a lounge chair system, more particularly to a system equipped with a television that can be positioned in front of the user's face while he/she is reclined.

BACKGROUND OF THE INVENTION

Many individuals find themselves waiting for extended periods of time, for example at airports, train stations, hospitals, on trains, on airplanes, buses, etc. The present invention features an entertainment chair system for providing a comfortable means of resting and being entertained. For example, the chair system provides a comfortable reclining seat equipped with a television that can be positioned in front of the user's face while he/she is reclined.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features an entertainment chair system. In some embodiments, the system comprises a first half platform and a second half platform pivotally connected via a pivot point, the first half platform and the second half platform together form a reclining seat, the first half platform functions to support a user's back, neck, and head, and the second half platform functions to support a user's buttocks and legs, the first half platform is adapted to be reclined or elevated; a base having an inner compartment, the first half platform and the second half platform are mounted atop the base; a door disposed in the base, the door can move between at least an open position and a closed position respectively allowing and preventing access to the inner compartment of the base; a mounting system comprising a first arm pivotally attached to a first side of the first half platform and a second arm pivotally attached to a second side of the first half platform, both the first arm and the second arm support a television, the mounting system functions to position the television parallel to a top surface of the first half platform at or near the top end of the first half platform; and a dispensing system, the base is mounted atop the dispensing system, the dispensing system comprises items and a means of dispensing such items, wherein at least a button is operatively connected to the dispensing system wherein when the button is pressed the dispensing means is activated to dispense an item via a dispensing slot disposed in the dispensing system.

In some embodiments, a pad or a mattress is disposed on the first half platform, the second half platform, a portion thereof, or a combination thereof for comfort. In some embodiments, the door is positioned on a side of the base. In some embodiments, a door cavity is disposed in the second half platform, the door slides within the door cavity disposed between at least an open position and a closed position. In some embodiments, the entertainment chair system further comprises a handle disposed on the door for allowing a user to easily move the door between positions. In some embodiments, the handle is stored in a recess or slot disposed in the door such that the handle is flush with the door or second half platform when not in use.

In some embodiments, the mounting system is constructed from a material sufficiently flexible and rigid so as to allow for bending and positioning of the mounting system yet the mounting system remains in a fixed position after bending and positioning is completed. In some embodiments, the items include a pillow, a blanket, a towel, or food items. In some embodiments, the entertainment chair system further comprises a credit card reader system operatively connected to the television or to the door. In some embodiments, the credit card reader system comprises a timer/alarm system for alerting a user when time has expired.

DESCRIPTION OF PREFERRED EMBODIMENTS

Referring now to FIGS. 1-5, the present invention features an entertainment chair system 100 for providing a comfortable means of resting and being entertained. For example, the chair system 100 provides a comfortable reclining seat equipped with a television that can be positioned in front of the user's face while he/she is reclined. The system 100 can be set up so that users pay for use of the chair (for a certain length of time, for example).

Figure 1:
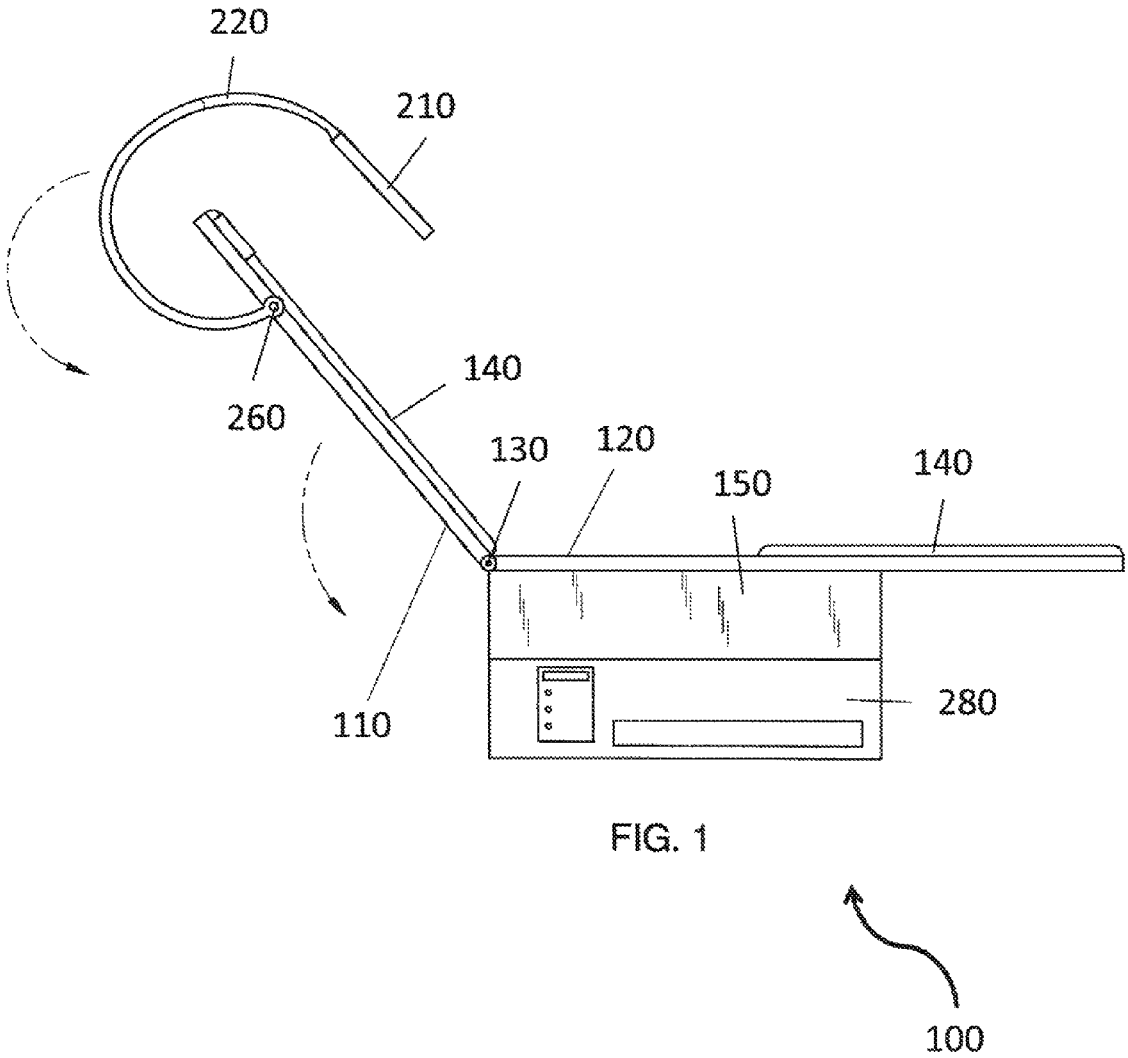
FIG. 1 is a side view of the entertainment chair system of the present invention.

The system 100 of the present invention comprises a first half platform 110 and a second half platform 120 pivotally connected (e.g., via a pivot point 130, such as a hinge, etc.). Together the platforms 110, 120 form a reclining seat like a lounge chair. The platforms 110, 120 are padded for comfort. In some embodiments, a mattress 140 is mounted atop the platforms 110, 120 or a portion thereof. As shown in FIG. 1, the first half platform 110 functions to support a user's back, neck, and head, and the second half platform 120 functions to support a user's buttocks and legs. The first half platform 110 can be adjusted for a user's comfort. For example, the user can recline or elevate the first half platform 110 to an upright or fully recline position (or a position in between, etc.).

The platforms are mounted atop a base 150. In some embodiments, the base comprises an inner compartment 152, which may be used for storage purposes (e.g., for luggage 154, etc.). For example a door 158 may be disposed in the base 150 that can move between multiple positions including but not limited to an open position and a closed position respectively allowing and preventing access to the inner compartment of the base 150. The door 158 may be positioned in the second half platform 120 or on a side of the base 150. For example, the door 158 may slide within a door cavity 156 in the second half platform 120 between an open position and a closed position (and/or other positions). The present invention is not limited to the aforementioned door placements. A handle 159 may be disposed on the door for allowing a user to easily move the door between the open and closed positions (see FIG. 2). In some embodiments, the handle 159 can be stored in a recess or slot in the door 158 such that the handle 159 is flush with the door or second half platform 120 when not in use (see FIG. 5).

Figure 2:
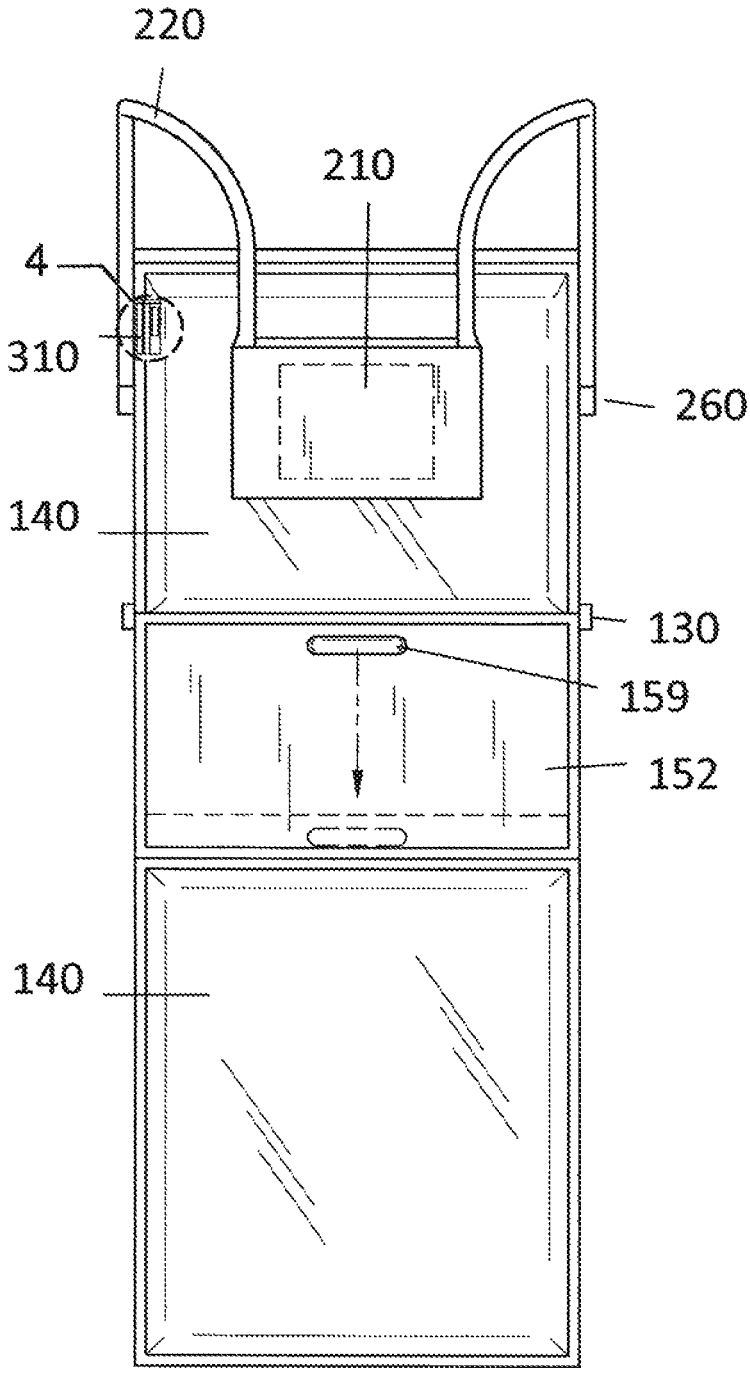
FIG. 2 is a top view of the entertainment chair system of FIG. 1.

The system 100 of the present invention further comprises a television 210 mounted on a mounting system 220. The mounting system 220 functions to position the television 210 parallel to the first half platform 110 at the top end of the first half platform 110 such that the television 210 is directly in front of the user's face when he/she lies on the platforms 110, 120. The mounting system 220 is pivotally attached to the first half platform via a second pivot point 260 (see FIG. 1, FIG. 2). As shown in FIG. 2, the mounting system 220 comprises a first arm pivotally attached to a first side of the first half platform 110 and a second arm pivotally attached to a second side of the first half platform 120. Both arms support the television 210. In some embodiments, the mounting system 220 is constructed from materials sufficiently flexible and rigid so as to allow for the bending and positioning of the mounting system 220 while remaining in a fixed position after then bending process is completed. Such materials are well known to one of ordinary skill in the art.

Figure 5:
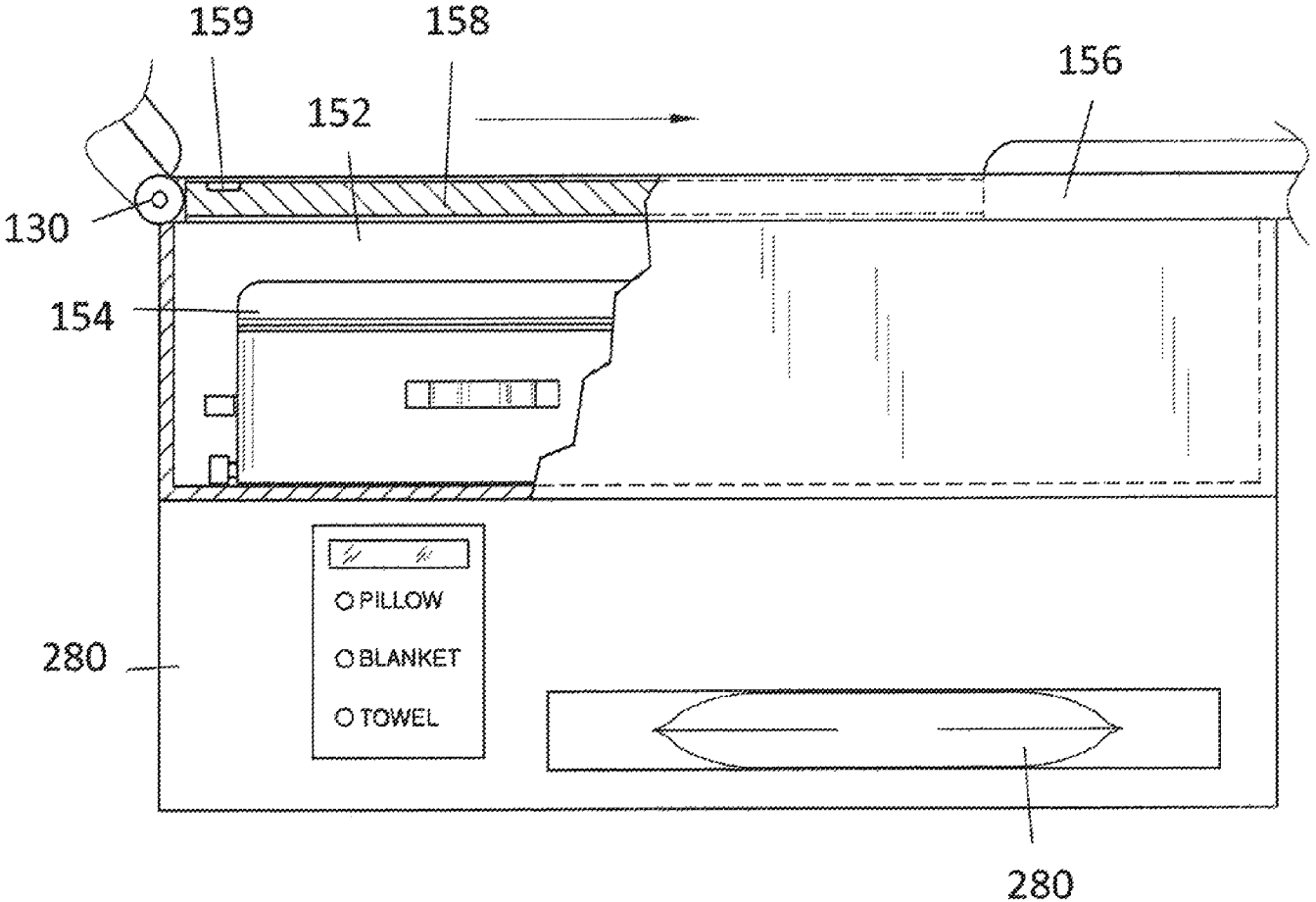
FIG. 5 is a side cross sectional view of the entertainment chair system of FIG. 1.

In some embodiments, the base 150 is mounted atop a dispensing system 280, which functions to dispense items of interest to a user including but not limited to a pillow 282, a blanket, a towel, food items (e.g., food items found in vending machines) etc. As shown in FIG. 5, the dispensing system 280 stores such items inside and when a particular button is pressed based on the user's choice, the dispensing system 280 dispenses the item out of a dispensing slot.

In some embodiments, the system 100 of the present invention is set up such that a user can pay to use the system 100 for a certain length of time. In some embodiments, the system 100 of the present invention further comprises a credit card reader system 310 for allowing a user to pay for use for a certain length of time. Credit card reader systems are well known to one of ordinary skill in the art. In some embodiments, the credit card reader system 310 comprises a timer/alarm system 320 for alerting a user when his/her time has expired.

Figure 3:
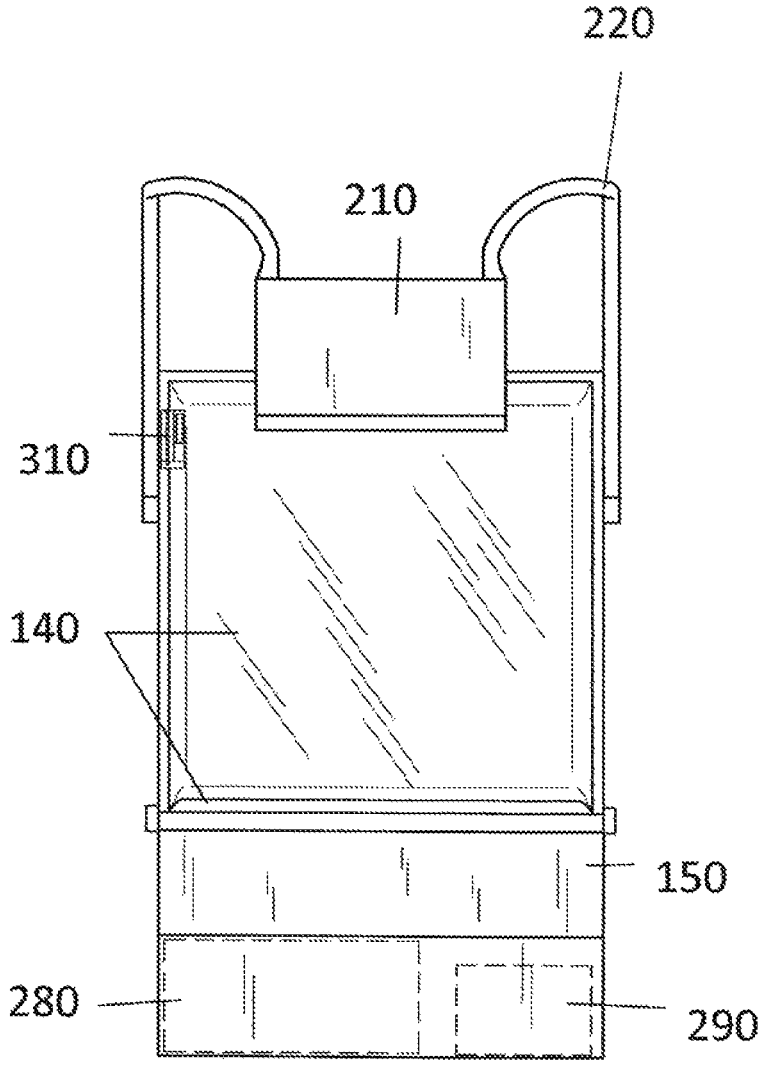
FIG. 3 is a front view of the entertainment chair system of FIG. 1.
Figure 4:
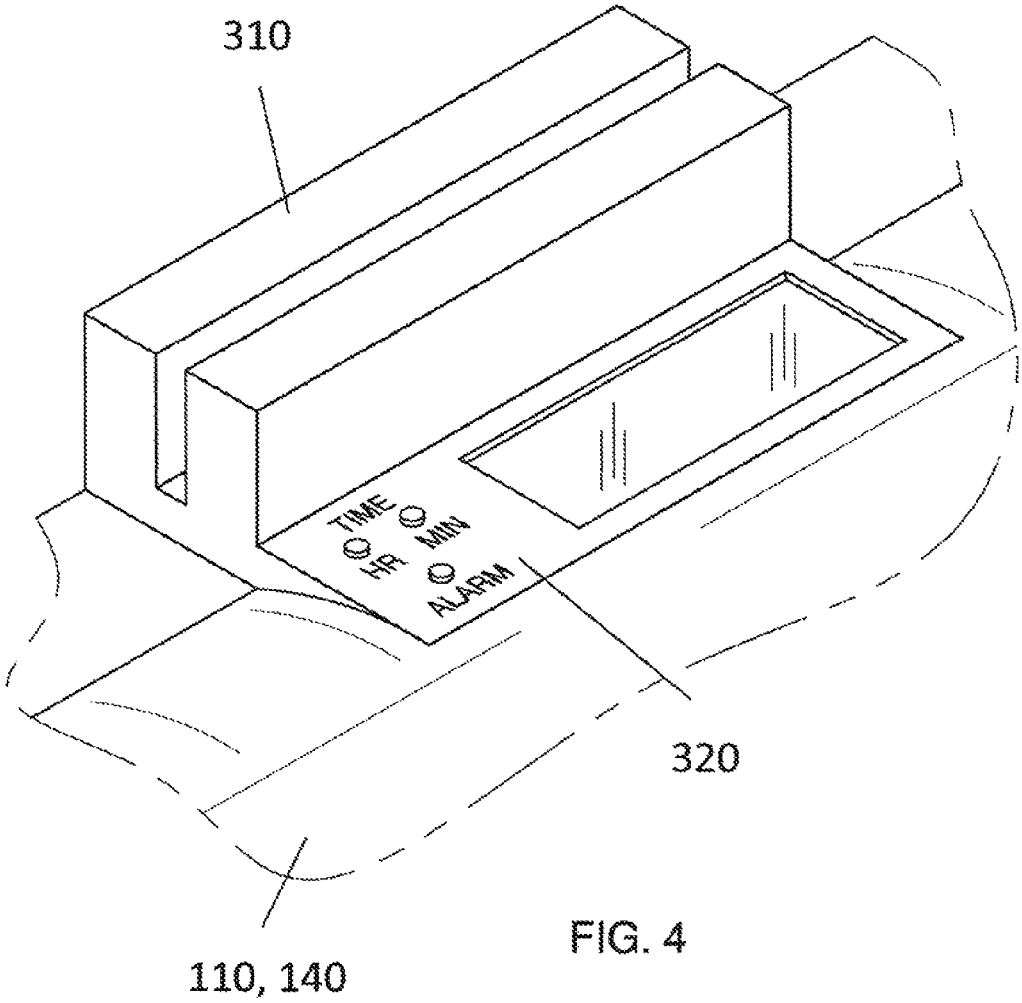
FIG. 4 is a detailed view of the credit card reader system entertainment chair system of FIG. 2.

As shown in FIG. 3, the system 100 of the present invention comprises a power source for providing power to components of the system 100 including but not limited to the television 210, the dispensing system 280, and the credit card reader system 310/alarm component 320. The power source may include a battery 290 or an electrical outlet (e.g., via a power cord). In some embodiments, the power source (e.g., battery 290) is stored in the base 150 or the dispensing system 280.

In some embodiments, the door 158 is designed to close only when a user has paid for a certain length of time.

The disclosures of the following U.S. patents are incorporated in their entirety by reference herein: U.S. Pat. No. 3,553,911; U.S. Pat. No. 3,556,088; U.S. Pat. No. 5,086,755; U.S. Pat. No. 3,923,134; U.S. Pat. No. 4,594,817; U.S. Pat. No. D336,999.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An entertainment chair system comprising:

(a) a first half platform and a second half platform pivotally connected via a pivot point, the first half platform and the second half platform together form a reclining seat, the first half platform functions to support a user's back, neck, and head, and the second half platform functions to support a user's buttocks and legs, the first half platform is adapted to be reclined or elevated;

(b) abuse having an inner compartment, the first half platform and the second half platform are mounted atop the base;

(c) a door disposed in the base, the door can move between at least an open position and a closed position respectively allowing and preventing access to the inner compartment of the base; wherein the door slides within a door cavity disposed in the second half platform;

(d) a mounting system comprising a first arm pivotally attached to a first side of the first half platform and a second arm pivotally attached to a second side of the first half platform, both the first arm and the second arm support a television, the mounting system functions to position the television parallel to a top surface of the first half platform at or near the top end of the first half platform; and (e) a dispensing system, the base is mounted atop the dispensing system, the dispensing system comprises items and a means of dispensing such items, wherein at least a button is operatively connected to the dispensing system wherein when the button is pressed the dispensing means is activated to dispense an item via a dispensing slot disposed in the dispensing system.

2. The entertainment chair system of claim 1, wherein a pad or a mattress is disposed on the first half platform, the second half platform, a portion thereof, or a combination thereof for comfort.

3. The entertainment chair system of claim 1 further comprising a handle disposed on the door for allowing a user to easily move the door between positions.

4. The entertainment chair system of claim 3, wherein the handle is stored in a recess or slot disposed in the door such that the handle is flush with the door or second half platform when not in use.

5. The entertainment chair system of claim 1, wherein the mounting system is constructed from a material sufficiently flexible and rigid so as to allow for bending and positioning of the mounting system yet the mounting system remains in a fixed position after bending and positioning is completed.

6. The entertainment chair system of claim 1, wherein the items include a pillow, a blanket, a towel, or food items.

7. The entertainment chair system of claim 1 further comprising a credit card reader system operatively connected to the television or to the door.

8. The entertainment chair system of claim 7, wherein the credit card reader system comprises a timer/alarm system for alerting a user when time has expired.

9. An entertainment chair system consisting of:

(a) a first half platform and a second half platform pivotally connected via a pivot point, the first half platform and the second half platform together form a reclining seat, the first half platform functions to support a user's back, neck, and head, and the second half platform functions to support a user's buttocks and legs, the first half platform is adapted to be reclined or elevated;

(b) a base having an inner compartment, the first half platform and the second half platform are mounted atop the base;

(c) a door disposed in the base, the door can move between at least an open position and a closed position respectively allowing and preventing access to the inner compartment of the base; wherein the door slides within a door cavity disposed in the second half platform;

(d) a mounting system consisting of a first arm pivotally attached to a first side of the first half platform and a second arm pivotally attached to a second side of the first half platform, both the first arm and the second arm support a television, the mounting system functions to position the television parallel to a top surface of the first half platform at or near the top end of the first half platform; and (e) a dispensing system, the base is mounted atop the dispensing system, the dispensing system consisting of items and a means of dispensing such items, wherein at least a button is operatively connected to the dispensing system wherein when the button is pressed the dispensing means is activated to dispense an item via a dispensing slot disposed in the dispensing system.

* * * * *